US006215449B1

(12) United States Patent
O'Neill, Jr.

(10) Patent No.: US 6,215,449 B1
(45) Date of Patent: Apr. 10, 2001

(54) SYSTEMS AND METHODS FOR COAXIALLY COUPLING AN ANTENNA THROUGH AN INSULATOR

(75) Inventor: Gregory A. O'Neill, Jr., Apex, NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/248,887

(22) Filed: Feb. 11, 1999

(51) Int. Cl.[7] ..... H01Q 1/32; H01P 1/04
(52) U.S. Cl. ..... 343/713; 333/24 C; 343/859
(58) Field of Search ..... 333/24 R, 24 C, 333/255; 343/713, 859, 700 MS

(56) References Cited

U.S. PATENT DOCUMENTS

| | | | |
|---|---|---|---|
| 2,829,367 | 4/1958 | Rychlik | 343/850 |
| 3,676,744 | 7/1972 | Pennypacker . | |
| 4,621,243 | 11/1986 | Harada | 333/24 R |
| 4,623,858 | 11/1986 | Montesanto et al. | 333/255 |
| 4,764,773 | 8/1988 | Larsen et al. | 343/713 |
| 4,839,660 | 6/1989 | Hadzoglou | 343/715 |
| 5,099,252 | 3/1992 | Bryant et al. | 343/713 |
| 5,155,494 | 10/1992 | Bryant et al. | 343/713 |
| 5,212,492 | 5/1993 | Jesman et al. | 343/713 |
| 5,428,830 | 6/1995 | Zerod et al. | 455/282 |
| 5,451,966 | 9/1995 | Du et al. | 343/715 |
| 5,557,290 | 9/1996 | Watanabe | 343/713 |
| 5,600,333 | 2/1997 | Justice et al. | 343/713 |
| 5,734,355 | 3/1998 | Watanabe | 343/859 |
| 5,828,946 | 10/1998 | Feisullin et al. | 455/5.1 |
| 5,977,841 | 11/1999 | Lee et al. | 334/24 C |

FOREIGN PATENT DOCUMENTS 0 856 905 A1 8/1998 (EP) .

OTHER PUBLICATIONS

Haartsen, "*Bluetooth–The Universal Radio Interference For Ad Hoc, Wireless Connectivity*", Ericsson Review, No. 3, 1998, pp. 110–117.

Kraus, "*System Temperature and Signal–to–Noise Radio*", Antennas, Second Edition, McGraw–Hill, 1988, pp. 782–787.

*Primary Examiner*—Benny T. Lee
*Assistant Examiner*—Stephen E. Jones
(74) *Attorney, Agent, or Firm*—Myers Bigel Sibley & Sajovec

(57) ABSTRACT

Coaxial coupling systems and methods couple a first coaxial cable that includes a first inner conductor and first shield conductor to a second coaxial cable that includes a second inner conductor and a second shield conductor, through an insulator that includes first and second insulator surfaces. A first center plate and a first surrounding plate are adapted for attachment to the first insulator surface such that the first surrounding plate surrounds the first center plate on the first insulator surface. The first center plate is electrically connected to the first inner conductor and the first surrounding plate is electrically connected to the first shield conductor. A second center plate and a second surrounding plate are adapted for attachment to the second insulator surface such that the second surrounding plate surrounds the second center plate on the second insulator surface, the first and second center plates are adjacent one another with the insulator therebetween and the first and second surrounding plates are adjacent one another and the insulator therebetween. The second center plate is electrically connected to the second inner conductor and the second surrounding plate is electrically connected to the second shield conductor. The coaxial coupling systems and methods can allow communication signals to pass with low insertion loss, over a desired frequency range, between an antenna mounted outside a window and a radio transceiver mounted inside the window. Transmission takes place via a coaxial transmission line on each side of the window.

76 Claims, 7 Drawing Sheets

FREQUENCY 1500.0 TO 1700.0 MHz

SYSTEMS AND METHODS FOR COAXIALLY COUPLING AN ANTENNA THROUGH AN INSULATOR

CROSS-REFERENCE TO RELATED APPLICATION

This application is related to application Ser. No. 09/848,434, now U.S. Pat. No. 6,069,588 to the present inventor entitled "Systems and Methods for Coaxially Coupling an Antenna Through a Window and Amplifying Signals Adjacent and Inside The Window", filed concurrently and assigned to the assignee of the present application, the disclosure of which is hereby incorporated herein by reference.

FIELD OF THE INVENTION

This invention relates to coupling systems and methods and more particularly to systems and methods for coupling antennas through an insulator.

BACKGROUND OF THE INVENTION

Antenna coupling systems and methods are widely used to couple an antenna to a receiver through an insulator. For example in mobile radiotelephone communications, a radiotelephone such as a cellular radiotelephone may be mounted in the interior of a vehicle. An antenna may be mounted on the exterior of the vehicle. Coupling systems and methods are used to couple the antenna to the radiotelephone through an insulator such as a window.

It will be understood by those having skill in the art that although the present application will describe the coupling of mobile radiotelephones to antennas through a vehicle window, the present invention may be applied to any radio transceiver and the insulator need not be limited to windows. Moreover, the present invention need not be used in a mobile environment but also may be used to couple an antenna outside a building to a transceiver inside a building through an insulator.

It is known to use a capacitive plate on either side of a window to capacitively couple high frequency signals through the window. See U.S. Pat. No. 4,621,243 to Harada entitled "Transmission Channel Coupler for Antenna". This patent also describes the use of loop coils and helical resonators to transmit high frequencies through a window.

Multiple plates also may be used on either side of the window to capacitively couple signals therethrough. See for example, U.S. Pat. No. 2,829,367 to Rychlik entitled "Television Lead-In Coupler" and U.S. Pat. No. 4,764,773 to Larsen et al. entitled "Mobile Antenna and Through-the-Glass Impedance Matched Feed System".

Finally, it is also known to provide a collinear radiator mounted on one surface of a dielectric such as the window of a vehicle and a tunable coupling circuit disposed internally of a conductive housing mounted on the opposite surface of the dielectric. See U.S. Pat. No. 839,662 to Hadzoglou entitled "Cellular Mobile Communication Antenna".

In providing antenna coupling systems and methods, it generally is desirable to couple the antenna to the transceiver through the insulator with low insertion loss. For example, in satellite radiotelephones which may provide low link margins, it may be desirable to maintain insertion loss through the insulator of about 0.5 dB or less. Unfortunately, many conventional coupling systems produce an insertion loss of 2 dB or more.

Moreover, many high performance antennas employ two or more conductors rather than a single conductor. For example, a quadrifiler helix antenna may employ two or more conductors. Accordingly, it may be desirable to couple radio frequency signals via a coaxial cable from inside the insulator to a coaxial cable outside the insulator. In conclusion, notwithstanding the above described solutions, there continues to be a need for coaxial-to-coaxial coupling systems and methods that can provide high performance and low insertion loss.

SUMMARY OF THE INVENTION

It is therefore an object of the present invention to provide antenna coupling systems and methods that can provide low insertion loss across an insulator.

It is another object of the present invention to provide antenna coupling systems and methods that can couple coaxial cables through an insulator.

These and other objects are provided, according to the present invention by coaxial coupling systems and methods that couple a first coaxial cable that includes a first inner conductor and first shield conductor to a second coaxial cable that includes a second inner conductor and a second shield conductor, through an insulator that includes first and second insulator surfaces. A first center plate and a first surrounding plate are adapted for attachment to the first insulator surface such that the first surrounding plate surrounds the first center plate on the first insulator surface. The first center plate is electrically connected to the first inner conductor and the first surrounding plate is electrically connected to the first shield conductor. A second center plate and a second surrounding plate are adapted for attachment to the second insulator surface such that the second surrounding plate surrounds the second center plate on the second insulator surface, the first and second center plates are adjacent one another with the insulator therebetween and the first and second surrounding plates are adjacent one another with the insulator therebetween. The second center plate is electrically connected to the second inner conductor and the second surrounding plate is electrically connected to the second shield conductor.

It has been found according to the present invention, that coaxial coupling systems and methods as described above can allow communication signals to pass with low insertion loss, over a desired frequency range, between an antenna mounted outside a window and a radio transceiver mounted inside the window. Transmission takes place via a coaxial transmission line on each side of the window. Moreover, by allowing two or more conductors to be capacitively coupled. a "single port" or "multiport" circuit may be provided for high performance antennas.

In a preferred embodiment, the first and second center plates are first and second disks and the first and second surrounding plates are first and second rings. More preferably, the first and second rings are first and second continuous rings. Moreover, a first inductor is preferably electrically connected between the first center plate and the first surrounding plate and a second inductor is preferably electrically connected between the second center plate and the second surrounding plate. A pair of first pads may be included, a respective one of which is on the first center plate and on the first surrounding plate so that the first inductor is electrically connected between the pair of first pads. A pair of second pads also may be included, a respective one of which is on the second center plate and on the second surrounding plate so that the second inductor is electrically connected between the pair of second pads.

A preferred configuration of the present invention can provide reduced insertion loss over a wide band, while reducing unwanted stray couplings. In particular, the first inner conductor is electrically connected to the first center plate at a first position thereon and the first inductor is electrically connected to the first center plate at a second position that is remote from the first position. The second inner conductor is preferably electrically connected to the second center plate at a first position thereon and is preferably electrically connected to the second center plate at a second position that is remote from the first position.

More preferably, the first position on the first center plate is adjacent the second position on the second center plate and the second position on the first center plate is adjacent the first position on the first center plate. Even more preferably, the first shield conductor is electrically connected to the first surrounding plate at a first position thereon and the second shield conductor is electrically connected to the second surrounding plate at a second position thereon that is remote from the first position on the first surrounding plate.

Most preferably, the first shield conductor is also electrically connected to the first surrounding plate at a first position thereon and the second shield conductor is electrically connected to the second surrounding plate at a second position thereon that is opposite the first position on the first surrounding plate. Thus, the first and second coaxial cables preferably emerge from the coupling system in opposite directions to reduce unwanted parasitic coupling. The first and second inductors preferably also are located at opposite locations from one another to reduce mutual inductance.

In another preferred aspect of the invention, the first center plate and the first surrounding plate define a first gap therebetween and the second center plate and the second surrounding plate define a second gap therebetween. The first shield conductor preferably extends into the first gap and the second shield conductor preferably extends into the second gap. More preferably, the first shield conductor extends midway into the first gap and the second shield conductor extends midway into the second gap.

The first center plate and the surrounding plate may be contained in a first housing. The second center plate and the second surrounding plate may be contained in a second housing. An alignment key may be provided on at least one of the first and second housings to facilitate alignment of the first housing and the second housing relative to one another on the respective first and second surfaces of the insulator.

The present invention may be used to couple an antenna to a radiotelephone through a window including an outside surface and an inside surface. Thus, as described above, the first coaxial cable includes a first inner conductor and a first shield conductor that are coupled to the antenna. The second coaxial cable includes a second inner conductor and a second shield conductor that are coupled to the radiotelephone. However, as described above, the present invention may be used in other coupling applications.

Methods according to the present invention may be used for coupling a first coaxial cable that includes a first inner conductor and a first shield conductor to a second coaxial cable that includes a second inner conductor and a second shield conductor, through an insulator that includes first and second insulator surfaces. A first center plate and a first surrounding plate are attached to the first insulator surface such that the first surrounding plate surrounds the first center plate on the first surface. The first center plate is electrically connected to the first inner conductor and the first surrounding plate is electrically connected to the first shield conductor. A second center plate and a second surrounding plate are attached to the second insulator surface such that the second surrounding plate surrounds the second center plate on the second surface, the first and second center plates are adjacent one another with the insulator therebetween, and the first and second surrounding plates are adjacent one another with the insulator therebetween. The second center plate is electrically connected to the second inner conductor and the second surrounding plate is electrically connected to the second shield conductor. The first center plate also may be inductively coupled to the first surrounding plate and the second center plate also may be inductively coupled to the second surrounding plate. Coaxial coupling systems and methods may thereby be provided to couple coaxial lines through an insulator with low insertion loss over a desired frequency range.

DETAILED DESCRIPTION OF PREFERRED EMBODIMENTS

Figure 1A:
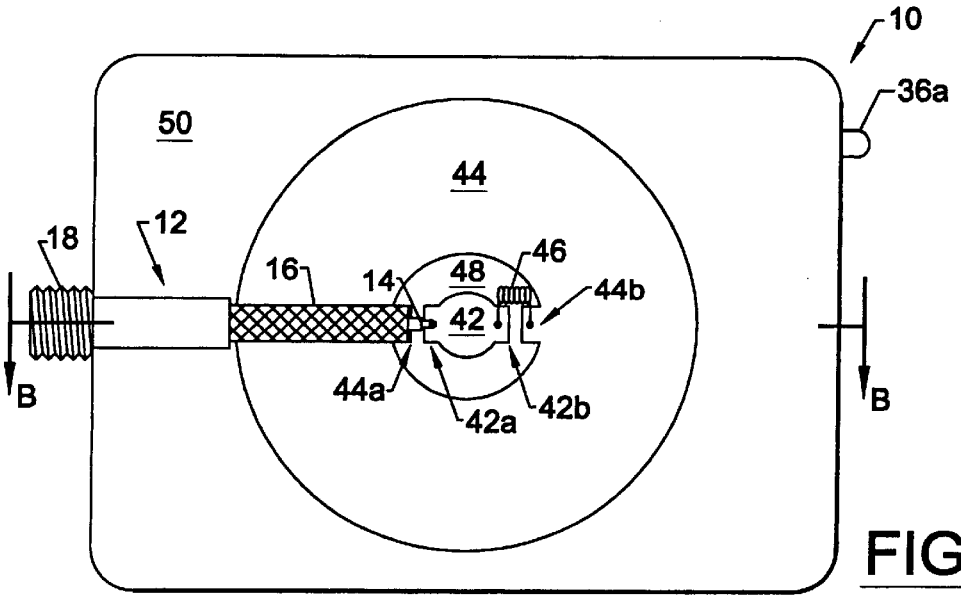
FIGS. 1A, 1B and 1C are a top view, a cross-sectional view and a bottom view respectively, illustrating systems and methods for coupling a first coaxial cable to a second coaxial cable through an insulator according to the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout. It will be understood that when an element is referred to as being "on" another element, it can be directly on the other element or intervening elements may also be present. In contrast, when an element is referred to as being "directly on" another element, there are no intervening elements present.

Figure 1B:
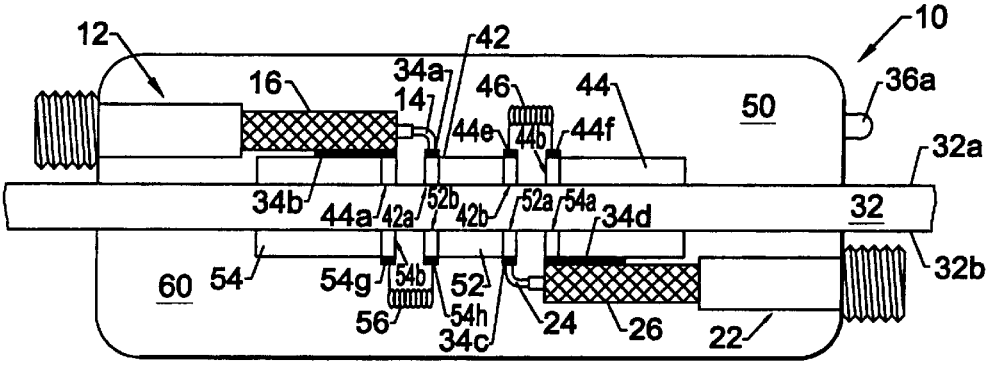
Figure 1C:
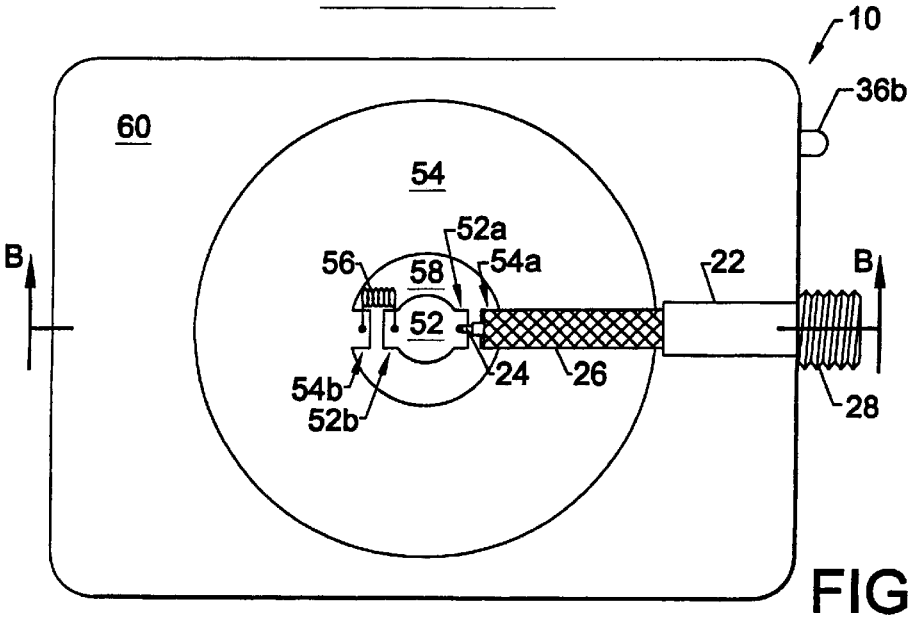

Referring now to FIGS. 1A, 1B and 1C, a top view, cross-sectional view and bottom view, respectively, illustrating systems and methods for coupling a first coaxial cable to a second coaxial cable through an insulator. As shown in FIGS. 1A–1C, coupling systems and methods 10 couple a first coaxial cable 12 that includes a first inner conductor 14 and a first shield conductor 16 to a second coaxial cable 22 including a second inner conductor 24 and a second shield conductor 26, through an insulator 32 such as a windshield or other glass that includes first and second insulator surfaces 32*a* and 32*b* respectively. As is well known to those having skill in the art, each coaxial cable also may include an inner insulator and an outer jacket.

A first center plate 42 and a first surrounding plate 44 are adapted for attachment to the first insulator surface 32*a* using adhesive, fasteners and/or other conventional attaching means, such that the first surrounding plate 44 surrounds the first center plate 42 on the first surface 32*a*. The first center plate 42 is electrically connected to the first inner conductor 14 using solder 34*a* and/or other conventional electrical connecting means. The first surrounding plate 44 is electrically connected to the first shield conductor 16 using solder 34*b* and/or other conventional electrical connecting means.

A second center plate 52 and a second surrounding plate 54 also are adapted for attachment to the second insulator surface 32*b* using adhesive, fasteners and/or other conventional attaching means such that the second surrounding plate 54 surrounds the second center plate 52 on the second surface 32*b*. As shown, the first and second center plates 42 and 52 respectively are adjacent one another with the insulator 32 therebetween. Also, the first and second surrounding plates 44 and 54 are adjacent one another with the insulator 32 therebetween. The second center plate 52 is electrically connected to the second inner conductor 24 using solder 34*c* and/or other conventional electrical connecting means. The second surrounding plate 54 is electrically connected to the second shield conductor 26 using solder 34*d* and/or other electrical connecting means.

As shown in FIGS. 1A–1C, the first and second center plates 42 and 52 respectively, preferably are first and second disks. The first and second surrounding plates 44 and 54 respectively, preferably are first and second rings. As also shown in FIGS. 1A–1A, the first and second rings 44 and 54 respectively, preferably are first and second continuous rings. However, polygonal shaped center plates and surrounding plates, including but not limited to square shaped center plates and surrounding plates may be used, and gaps may be present in the center plates and/or surrounding plates so that they are not continuous.

A first inductor 46 is electrically connected between the first center plate 42 and the first surrounding plate 44 using solder 44*e*, 44*f* and/or other conventional electrical connecting means. A second inductor 56 is electrically connected between the second center plate 52 and the second surrounding plate 54 using solder 54*g*, 54*h* and/or other conventional electrical connecting means. More than one inductor also may be electrically connected between a center plate and a surrounding plate as will be described below.

The coaxial cables 12 and 22 and the inductors 46 and 56 may be electrically connected to the center plates and surrounding plates at any arbitrary position thereon. However, preferably, they are connected as illustrated in FIGS. 1A–1C to reduce and preferably minimize unwanted couplings and parasitics. More specifically, the first inner conductor 14 preferably is electrically connected to the first center plate 42 at a first position 42*a* thereon and the first inductor 46 preferably is electrically connected to the first center plate 42 at a second position 42*b* that is remote from the first position. The second inner conductor 24 preferably is electrically connected to the second center plate 52 at a first position 52*a* thereon and the second inductor 56 preferably is electrically connected to the second center plate 54 at a second position 52*b* that is remote from the first position 52*a*. Moreover, the first position 42*a* on the first center plate 42 preferably is adjacent the second position 52*b* on the second center plate 52. The second position 42*b* on the first center plate 42 preferably is adjacent the first position 52*a* on the second center plate 52.

The first shield conductor 16 preferably is electrically connected to the first surrounding plate 44 at a first position 44*a* thereon. The second shield conductor 26 preferably is electrically connected to the second surrounding plate 54 at a second position 54*a* thereon that is remote from, and preferably opposite, the first position 44*a* on the first surrounding plate 44. Moreover, the first inductor 46 preferably is electrically connected to the first surrounding plate 44 at a second position 44*b* that is remote from, and more preferably opposite, the first position 44*a*. The second inductor 56 is preferably connected to the second surrounding plate 54 at a second position 54*b* that is remote from, and more preferably opposite, the first position 54*a*. Thus, as shown, the first and second coaxial cables preferably emerge from opposite directions and the first inductors preferably are located remote from one another.

As also shown in FIGS. 1A–1A, the first center plate 42 and the first surrounding plate 44 preferably define a first gap 48 therebetween and the second center plate 52 and the second surrounding plate 54 preferably define a second gap 58 therebetween. The first shield conductor 16 preferably extends into the first gap and the second shield conductor 26 preferably extends into the second gap 58. More preferably, as shown, the first shield 16 preferably extends midway into the first gap 48 and the second shield 26 preferably extends midway into the second gap 58.

Still referring to FIGS. 1A–1C, the first and second positions on each of the first center plate 42, first surrounding plate 44, second center plate 52 and second surrounding plate 54 may be defined using a tab such as a projecting tab. The tab can facilitate solder connection at the appropriate place on the center plates and surrounding plates. The tabs may be raised and may have a shape that enhances soldering. Multiple layers may be used for the tabs. However, it will be understood that the first and second positions on each of the center plates and surrounding plates need not be defined by specific features such as tabs.

Finally, a first housing 50 contains the first center plate 42 and the first surrounding plate 44. A second housing 60 contains the second center plate 52 and the second surrounding plate 54. The first housing 50 also may contain the coaxial cable 12 and a first coaxial cable connector 18. Similarly, the second housing 60 may also contain the second coaxial cable 22 and a second coaxial cable connector 28. It will be understood however, that the coaxial cable connectors 18 and 28 need not be contained within or be adjacent the housings, and may be eliminated entirely. Similarly, the coaxial cables 12 and 22 themselves may be outside the housings 50 and 60.

In order to facilitate alignment of the first housing 50 and the second housing 60 to one another on opposite surfaces of the insulator 32, an alignment key such as a pair of dimples 36*a*, 36*b* may be provided on a respective housing 50 and 60. Alternatively, alignment keys 36*a*, 36*b* may be painted or otherwise inscribed on the housings 50 and 60 and also may be provided by virtue of the overall shape of the housings 50 or 60. Alternatively, alignment keys need not be provided at all.

The materials and dimensions of the center plates, surrounding plates, inductors and housings may be varied depending on a particular application. However, the center plates and surrounding plates preferably comprise stamped copper and the housing preferably comprises plastic. The surrounding plates may have an outer diameter of about 45 mm and an inner diameter of about 20 mm. The center plate may have a diameter of about 15 mm so that a 2.5 mm gap is present. The plates may be less than one mm thick. The housings should preferably maintain a clear area above and below of about one cm. The inductors may be meandering line inductors rather than coils.

Figure 2A:
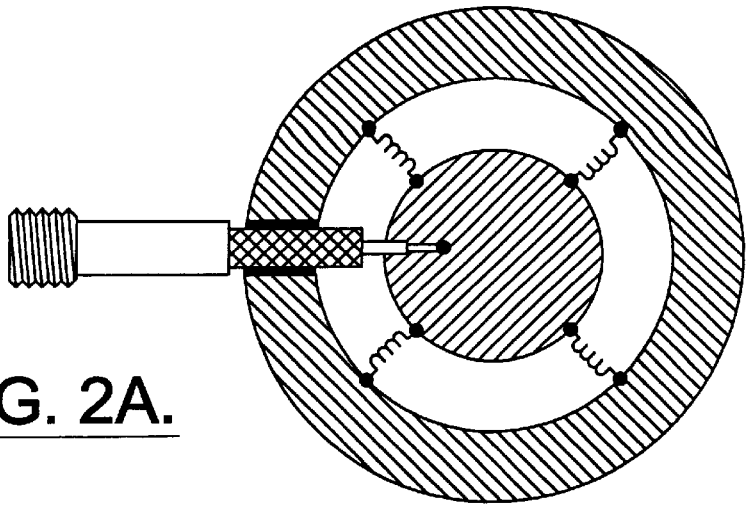
FIGS. 2A–2C illustrate alternate arrangements of coupling systems and methods according to the present invention.
Figure 2B:
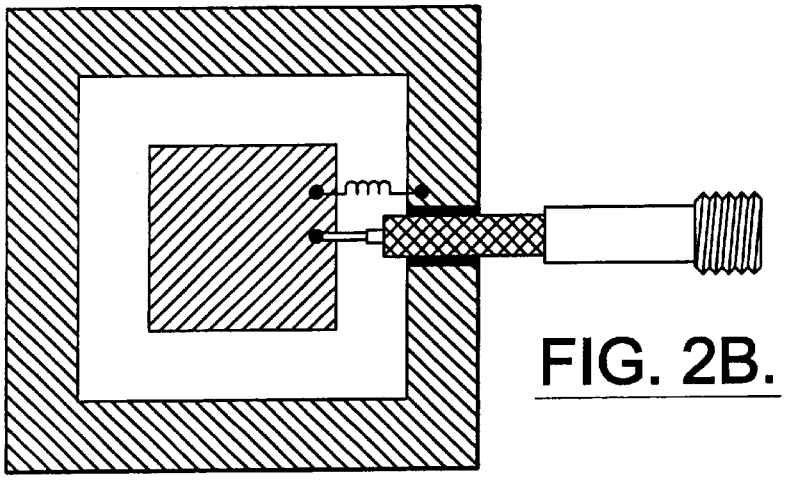
Figure 2C:
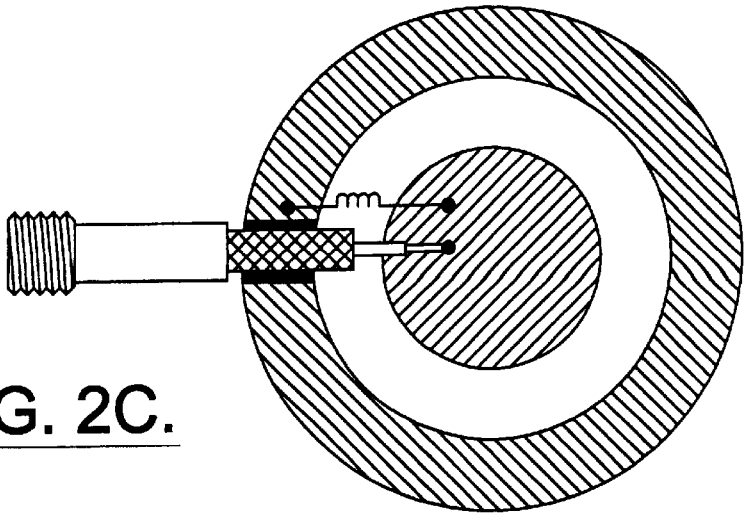

It will be understood that more than one inductor may be used to couple a respective center plate to a respective surrounding plate. Alternative arrangements of center plates, surrounding plates, and positioning of coaxial cables and inductors are shown in FIGS. 2A–2C. The inductance may be distributed to reduce the difficulty of fabricating small inductor values. Thus, for example, four-20 nH coils may be used to achieve a 5 nH coil.

Figure 3A:
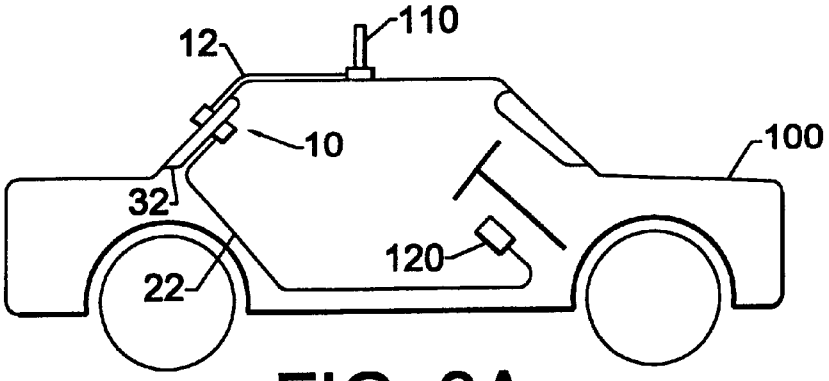
FIGS. 3A–3C illustrate alternate uses of coupling systems and methods according to the present invention to couple an antenna on the exterior of a vehicle to a radiotelephone within a vehicle.
Figure 3B:
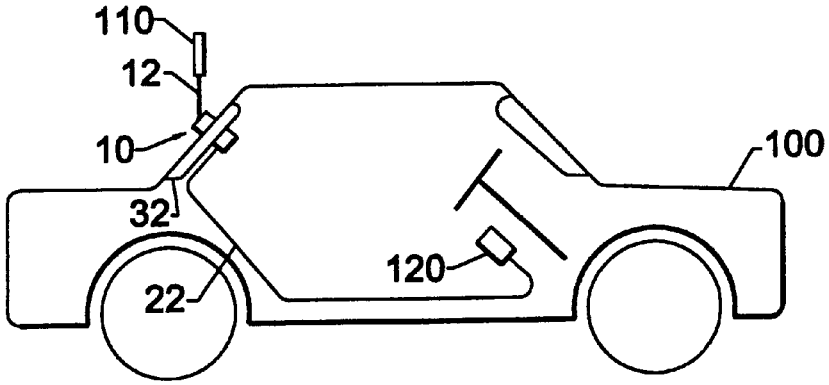
Figure 3C:
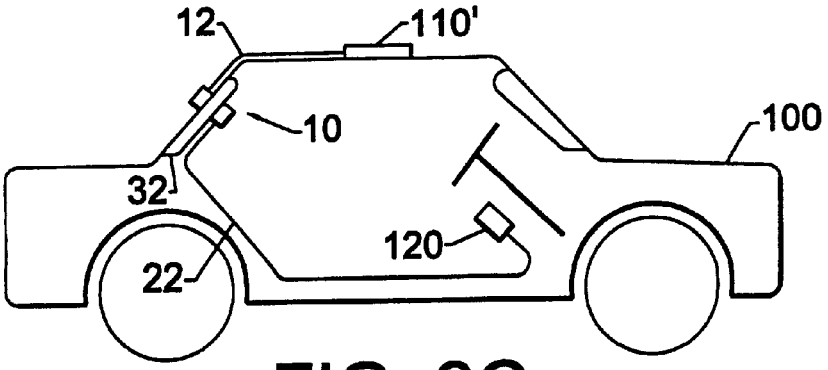

FIGS. 3A–3C illustrate the use of coupling systems and methods according to the present invention to couple an antenna on the exterior of a vehicle to a radiotelephone within a vehicle. As shown in FIG. 3A, coupling 10 is used to couple a first coaxial cable 12 that is connected to an antenna such as a quadrifilar helical antenna 110 on the roof of a vehicle 100, through the rear window 32 of the vehicle 100, to a second coaxial cable 22 that itself is coupled to a radiotelephone 120 within the vehicle 100. FIG. 3B illustrates a similar coupling except that the quadrifilar helical antenna 110 or other antenna is directly mechanically attached to the coupler housing on the rear window 32. FIG. 3C illustrates a similar embodiment to FIG. 3A except that a patch antenna 110' is used on the roof of the vehicle 100. It will be understood that other antennas may be used and other mounting positions for couplers, antennas and transceivers such as radiotelephones may be used. Coupling through windows other than the rear windshield also may be used.

As described above, the present invention may be used to coaxially couple two or more conductors through a window. A two-conductor circuit can provide for signal excitation and signal return to complete a circuit. This is known as a "single-port". Components having input ports and output ports, known as "two-ports" or "multiports" may be cascaded from single ports to modify the signal delivered to the output ports. Examples of such two-ports are transmission lines, duplexers, filters, as well as quadrature matching networks. A low loss, two conductor coupling according to the invention can enable these above-referred components to become part of the external network.

Additional design considerations for coupling systems and methods according to the present invention will now be provided. As was described, a center conductor capacitor plate is formed on each side of the glass together with an annular shield conductor capacitor plate around the center conductor plate. On either side of the capacitor plates, shunt inductors are placed from the center capacitor plate to the shield capacitor plate. Thus, a high-pass Pi-circuit is formed which can be equivalent to a short portion of transmission line.

There are several factors that may be considered in the design for a given frequency band. For example, for L-Band (1500–1700 MHz) the capacitor plates are somewhat large at the desired wavelength and may not be considered strictly as a lumped element. That is, there is a distributed nature to the capacitor due to its size. Moreover, coaxial cable is unbalanced so the capacitance of the surrounding plates may be desired to be larger than the center plates. It also may be advantageous to provide extra isolation space between the center plates and the shield plates. Further, the coaxial cables on each side of the glass should be physically isolated from each other in order to reduce extraneous conduction modes. The position of the inductors also may be selected to reduce propagation of extraneous conduction modes. Beyond these positioning guidelines, there may be relatively good tolerance to component value variations because there need not be narrowly tuned resonators in the coupler.

Couplers according to the invention can support the feed line requirements for circularly polarized antennas that use coaxial or at least two wire connections to the radiating structure. For example, an L-Band transceiver operates between 1500 and 1700 MHz. The present invention may be scaled for this frequency range. Below 1500 MHz there may be gradually increasing transmission loss due to the high-pass Pi-circuit. Above 1700 MHz the transmission loss may eventually increase due to other microwave modes that can be propagated via the structure.

The invention also can be scaled to higher or lower frequency ranges. Lower frequency ranges may include cellular radiotelephone frequency bands. Higher frequency ranges may include for example the PCS ranges around 1800 and 1900 MHz. Satellite radiotelephone transceivers in the lower S band also may be used with the present invention.

In order to design the circuit, an assumption may be made that the energy is to be sourced from a 50 Ω coaxial transmission line and the energy is to be delivered to a 50 Ω transmission line. An automotive windshield generally has a nominal dielectric of 7.5 at room temperature. Thus, a square centimeter area may have a capacitance of 1.24 $pF/cm^2$. Capacitance may be treated as part of a lumped element transmission line equivalent.

A simulation of a coupler according to the present invention was performed for L-Band. This simulation was based on the coaxial center window capacitance of 2.1 pF and shield window capacitance of 15 pF. The shunt inductors on each side of the window across the center to shield conductors had a value of 9.8 nH. In all component cases, component Q values were set at 50. The Q values contribute to a loss in the network.

Figure 4:
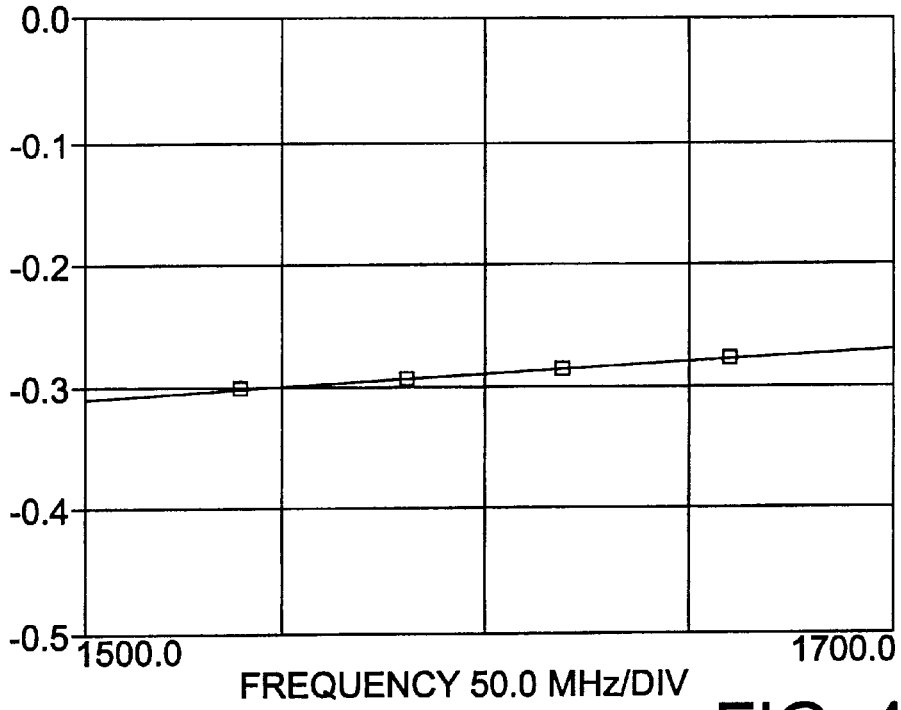
FIG. 4 graphically illustrates simulated attenuation loss for coupling systems and methods according to the present invention.

FIG. 4 graphically illustrates simulated attenuation loss from 1500 MHz through 1700 MHz. The network is basically a high pass structure with a shunt inductor, series capacitor and shunt inductor. The cutoff frequency of the network may be determined by the value of the series capacitor. The series capacitor was chosen with a sense of a tolerable size and in consideration of the shield capacitor that surrounds the center capacitor. In the case of the series capacitor, 2 nH of series inductance was provided for.

Figure 5:
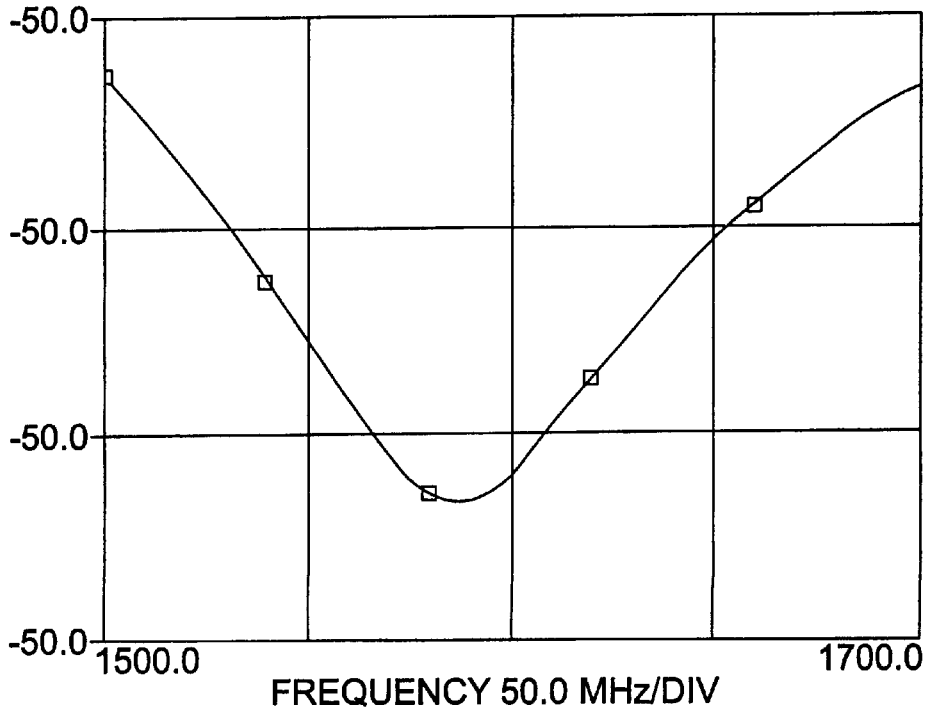
FIG. 5 graphically illustrates simulated return loss for coupling systems and methods according to the present invention.
Figure 6:
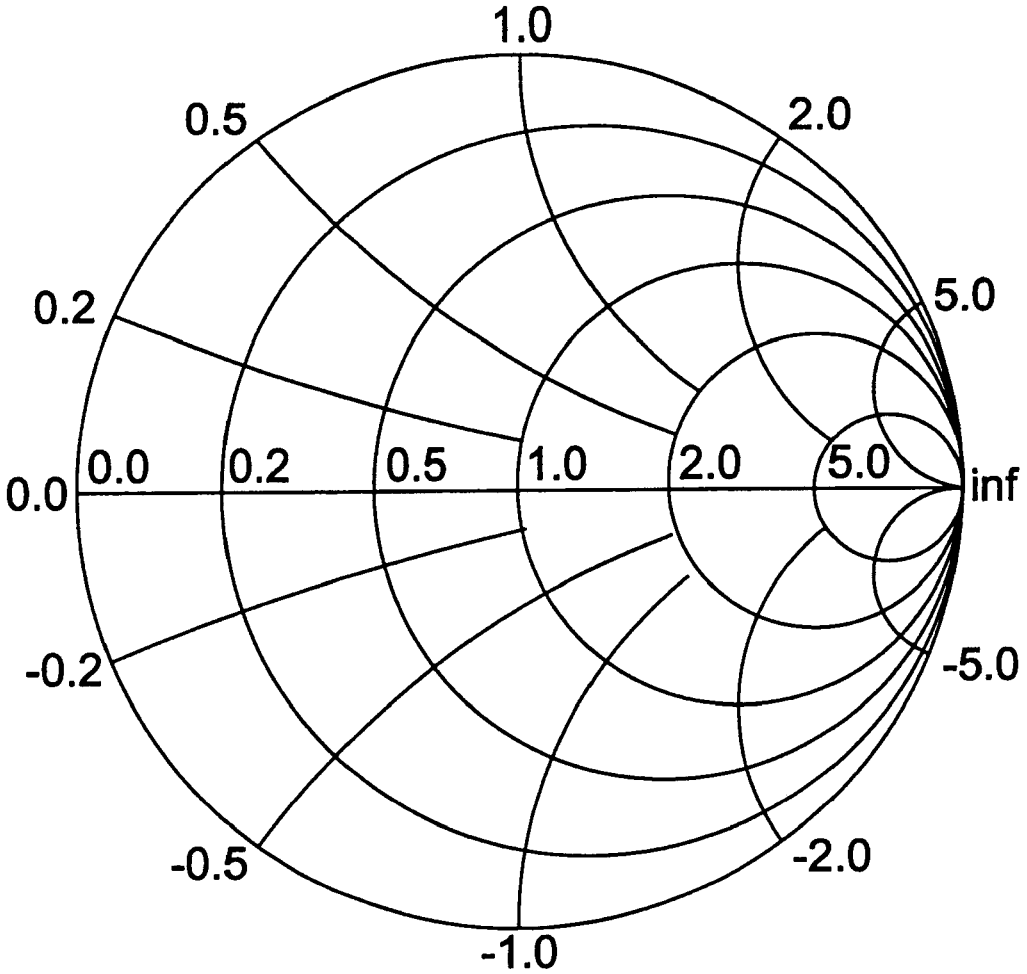
FIG. 6 is a Smith Chart that graphically illustrates simulated input impedance for coupling systems and methods according to the present invention.

FIG. 4 illustrates that a simulated insertion loss of about –0.3 dB may be obtained for values between 1500 MHz and 1700 MHz. FIG. 5 graphically illustrates return loss that shows a very good match over the frequency range of interest. FIG. 6 is a Smith Chart that shows the input impedance with the network terminated at 50 Ω. Accordingly, FIGS. 4–6 indicate that a transmission loss of less than 0.5 dB may be realized for L-Band coaxial coupling.

Figure 7:
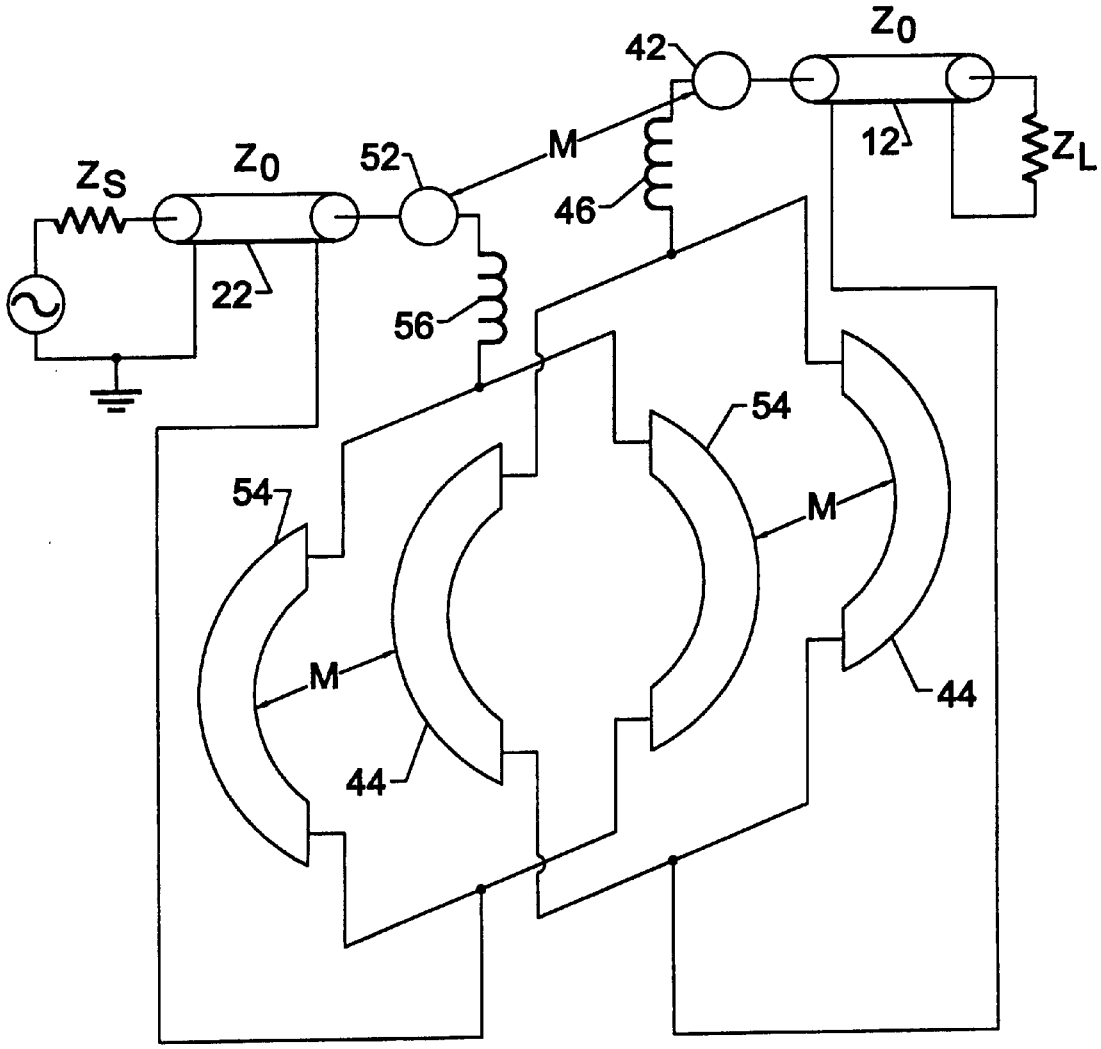
FIG. 7 is an equivalent circuit of coupling systems and methods according to the present invention.

FIG. 7 is an equivalent circuit of couplers according to the present invention. M indicates mutual coupling between elements. The first and second surrounding plates 44 and 54 respectively are broken into semicircles for purposes of the equivalent circuit.

Actual measurements were taken on a coupler according to the present invention using the above described parameters. In these measurements, the calibration used a small connector for the through connection. In this way, the loss of an equivalent length of RG-223 coaxial cable may be subtracted from the coupling with cable measurement. The coupling loss values in the right hand column of the following table result from these measurements.

TABLE

| Frequency (MHz) | Coupling with Cable Loss | Cable Loss | Coupling Loss |
|---|---|---|---|
| 1525 | 0.8024 dB | 0.3750 dB | 0.4274 dB |
| 1559 | 0.7994 dB | 0.3903 dB | 0.4091 dB |
| 1626 | 0.9095 dB | 0.3974 dB | 0.5121 dB |
| 1660 | 0.9762 dB | 0.3946 dB | 0.5816 dB |

Figure 8:
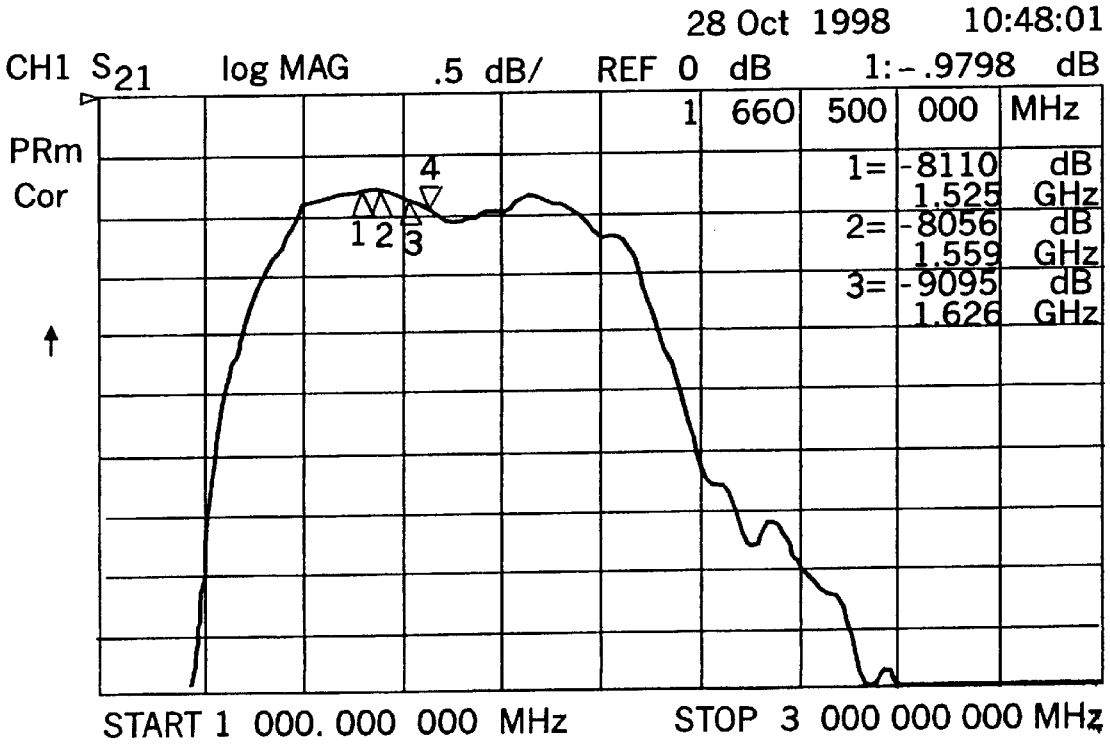
FIG. 8 graphically illustrates measured data for coupling systems and methods according to the present invention.

Measured data from 1.0 to 3.0 GHz is graphically illustrated in FIG. 8. This data includes a length of coaxial cable similar to the coupling with cable loss data above. The data shows the nature of the high pass filter up to about 2 GHz. The distributed nature of the coupling tends to cause a low pass relation to the curve toward 3 GHz. A wide bandwidth was therefore obtained, with low insertion loss.

Accordingly, coupling systems and methods of the present invention can allow communication signals to pass with low insertion loss, over a desired frequency range, between an antenna mounted outside a window and a radio transceiver mounted inside the window. Transmission takes place via a coaxial transmission line on each side of the window. Accordingly, single-port or multiport coupling may take place.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A system that couples a first coaxial cable that includes a first inner conductor and a first shield conductor to a second coaxial cable that includes a second inner conductor and a second shield conductor, through an insulator that includes first and second insulator surfaces, the system comprising:

a first center plate and a first surrounding plate that are adapted for attachment to the first insulator surface such that the first surrounding plate surrounds the first center plate on the first insulator surface, the first center plate being electrically connected to the first inner conductor and the first surrounding plate being electrically connected to the first shield conductor;

a second center plate and a second surrounding plate that are adapted for attachment to the second insulator surface such that the second surrounding plate surrounds the second center plate on the second insulator surface, the first and second center plates are adjacent one another with the insulator therebetween and the first and second surrounding plates are adjacent one another with the insulator therebetween, the second center plate being electrically connected to the second inner conductor and the second surrounding plate being electrically connected to the second shield conductor;

a first inductor that is electrically connected between the first center plate and the first surrounding plate and a second inductor that is electrically connected between the second center plate and the second surrounding plate;

wherein the first inner conductor is electrically connected to the first center plate at a first position thereon and wherein the first inductor is electrically connected to the first center plate at a second position that is remote from the first position; and wherein the second inner conductor is electrically connected to the second center plate at a first position thereon and wherein the second inductor is electrically connected to the second center plate at a second position that is remote from the first position.

2. A system according to claim 1 wherein the first and second center plates are first and second disks and wherein the first and second surrounding plates are first and second rings.

3. A system according to claim 2 wherein the first and second rings are first and second continuous rings.

4. A system according to claim 1 wherein the first position on the first center plate is adjacent the second position on the second center plate and wherein the second position on the first center plate is adjacent the first position on the second center plate.

5. A system according to claim 4 wherein the first shield conductor is electrically connected to the first surrounding plate at a first position thereon and wherein the second shield conductor is electrically connected to the second surrounding plate at a second position thereon that is remote from the first position on the first surrounding plate.

6. A system according to claim 5 wherein the first shield conductor is electrically connected to the first surrounding plate at a first position thereon and wherein the second shield conductor is electrically connected to the second surrounding plate at a second position thereon that is opposite the first position on the first surrounding plate.

7. A system according to claim 1 wherein the first shield conductor is electrically connected to the first surrounding plate at a first position thereon and wherein the second shield conductor is electrically connected to the second surrounding plate at a second position thereon that is opposite the first position on the first surrounding plate.

8. A system that couples a first coaxial cable that includes a first inner conductor and a first shield conductor to a second coaxial cable that includes a second inner conductor and a second shield conductor, through an insulator that includes first and second insulator surfaces, the system comprising:

a first center plate and a first surrounding plate that are adapted for attachment to the first insulator surface such that the first surrounding plate surrounds the first center plate on the first insulator surface, the first center plate being electrically connected to the first inner conductor and the first surrounding plate being electrically connected to the first shield conductor; and a second center plate and a second surrounding plate that are adapted for attachment to the second insulator surface such that the second surrounding plate surrounds the second center plate on the second insulator surface, the first and second center plates are adjacent one another with the insulator therebetween and the first and second surrounding plates are adjacent one another with the insulator therebetween, the second center plate being electrically connected to the second inner conductor and the second surrounding plate being electrically connected to the second shield conductor;

wherein the first shield conductor is electrically connected to the first surrounding plate at a first position thereon and wherein the second shield conductor is electrically connected to the second surrounding plate at a second position thereon that is not adjacent the first position on the first surrounding plate.

9. A system according to claim 8 wherein the first and second center plates are first and second disks and first and second surrounding plates are first and second rings.

10. A system according to claim 9 wherein the first and second rings are first and second continuous rings.

11. A system according to claim 8 further comprising a first inductor that is electrically connected between the first center plate and the first surrounding plate and a second inductor that is electrically connected between the second center plate and the second surrounding plate.

12. A system according to claim 11:

wherein the first inner conductor is electrically connected to the first center plate at a first position thereon and wherein the first inductor is electrically connected to the first center plate at a second position that is remote from the first position; and wherein the second inner conductor is electrically connected to the second center plate at a first position thereon and wherein the second inductor is electrically connected to the second center plate at a second position that is remote from the first position.

13. A system that couples a first coaxial cable that includes a first inner conductor and a first shield conductor to a second coaxial cable that includes a second inner conductor and a second shield conductor, through an insulator that includes first and second insulator surfaces, the system comprising:

a first center plate and a first surrounding plate that are adapted for attachment to the first insulator surface such that the first surrounding plate surrounds the first center plate on the first insulator surface, the first center plate being electrically connected to the first inner conductor and the first surrounding plate being electrically connected to the first shield conductor; and a second center plate and a second surrounding plate that are adapted for attachment to the second insulator surface such that the second surrounding plate surrounds the second center plate on the second insulator surface, the first and second center plates are adjacent one another with the insulator therebetween and the first and second surrounding plates are adjacent one another with the insulator therebetween, the second center plate being electrically connected to the second inner conductor and the second surrounding plate being electrically connected to the second shield conductor;

wherein the first center plate and the first surrounding plate define a first gap therebetween, wherein the second center plate and the second surrounding plate define a second gap therebetween, wherein the first shield conductor extends into the first gap and wherein the second shield conductor extends into the second gap.

14. A system according to claim 13 wherein the first shield conductor extends midway into the first gap and wherein the second shield conductor extends midway into the second gap.

15. A system according to claim 13 wherein the first and second center plates are first and second disks and first and second surrounding plates are first and second rings.

16. A system according to claim 15 wherein the first and second rings are first and second continuous rings.

17. A system according to claim 13 further comprising a first inductor that is electrically connected between the first center plate and the first surrounding plate and a second inductor that is electrically connected between the second center plate and the second surrounding plate.

18. A system according to claim 17:

wherein the first inner conductor is electrically connected to the first center plate at a first position thereon and wherein the first inductor is electrically connected to the first center plate at a second position that is remote from the first position; and wherein the second inner conductor is electrically connected to the second center plate at a first position thereon and wherein the second inductor is electrically connected to the second center plate at a second position that is remote from the first position.

19. A system that couples a first coaxial cable that includes a first inner conductor and a first shield conductor to a second coaxial cable that includes a second inner conductor and a second shield conductor, through an insulator that includes first and second insulator surfaces, the system comprising:

a first center plate and a first surrounding plate that are adapted for attachment to the first insulator surface such that the first surrounding plate surrounds the first center plate on the first insulator surface, the first center plate being electrically connected to the first inner conductor and the first surrounding plate being electrically connected to the first shield conductor;

a second center plate and a second surrounding plate that are adapted for attachment to the second insulator surface such that the second surrounding plate surrounds the second center plate on the second insulator surface, the first and second center plates are adjacent one another with the insulator therebetween and the first and second surrounding plates are adjacent one another with the insulator therebetween, the second center plate being electrically connected to the second inner conductor and the second surrounding plate being electrically connected to the second shield conductor;

a first inductor that is electrically connected between the first center plate and the first surrounding plate and a second inductor that is electrically connected between the second center plate and the second surrounding plate;

a pair of first pads, a respective one of which is on the first center plate and on the first surrounding plate, the first inductor being electrically connected between the pair of first pads; and a pair of second pads, a respective one of which is on the second center plate and on the second surrounding plate, the second inductor being electrically connected between the pair of second pads.

20. A system according to claim 19 wherein the first and second center plates are first and second disks and first and second surrounding plates are first and second rings.

21. A system according to claim 20 wherein the first and second rings are first and second continuous rings.

22. A system according to claim 19:

wherein the first inner conductor is electrically connected to the first center plate at a first position thereon and wherein the first inductor is electrically connected to the first center plate at a second position that is remote from the first position; and wherein the second inner conductor is electrically connected to the second center plate at a first position thereon and wherein the second inductor is electrically connected to the second center plate at a second position that is remote from the first position.

23. A system that couples a first coaxial cable that includes a first inner conductor and a first shield conductor to a second coaxial cable that includes a second inner conductor and a second shield conductor, through an insulator that includes first and second insulator surfaces, the system comprising:

a first center plate and a first surrounding plate that are adapted for attachment to the first insulator surface such that the first surrounding plate surrounds the first center plate on the first insulator surface, the first center plate being electrically connected to the first inner conductor and the first surrounding plate being electrically connected to the first shield conductor;

a second center plate and a second surrounding plate that are adapted for attachment to the second insulator surface such that the second surrounding plate surrounds the second center plate on the second insulator surface, the first and second center plates are adjacent one another with the insulator therebetween and the first and second surrounding plates are adjacent one another with the insulator therebetween, the second center plate being electrically connected to the second inner conductor and the second surrounding plate being electrically connected to the second shield conductor;

a first housing that contains the first center plate and the first surrounding plate;

a second housing that contains the second center plate and the second surrounding plate; and an alignment key on at least one of the first and second housings that facilitates alignment of the first housing and the second housing relative to one another on the respective first and second surfaces of the insulator.

24. A system according to claim 23 wherein the first and second center plates are first and second disks and first and second surrounding plates are first and second rings.

25. A system according to claim 24 wherein the first and second rings are first and second continuous rings.

26. A system according to claim 23 further comprising a first inductor that is electrically connected between the first center plate and the first surrounding plate and a second inductor that is electrically connected between the second center plate and the second surrounding plate.

27. A system according to claim 26:

wherein the first inner conductor is electrically connected to the first center plate at a first position thereon and wherein the first inductor is electrically connected to the first center plate at a second position that is remote from the first position; and wherein the second inner conductor is electrically connected to the second center plate at a first position thereon and wherein the second inductor is electrically connected to the second center plate at a second position that is remote from the first position.

28. A system that couples an antenna to a radiotelephone through a window including an outside surface and an inside surface, the system comprising:

a first coaxial cable that includes a first inner conductor and a first shield conductor that are coupled to the antenna;

a second coaxial cable that includes a second inner conductor and a second shield conductor that are coupled to the radiotelephone;

a first center plate and a first surrounding plate that are attached to the outside surface such that the first surrounding plate surrounds the first center plate on the first surface, the first center plate being electrically connected to the first inner conductor and the first surrounding plate being electrically connected to the first shield conductor;

a second center plate and a second surrounding plate that are attached to the inside surface such that the second surrounding plate surrounds the second center plate on the inside surface, the first and second center plates are adjacent one another with the window therebetween and the first and second surrounding plates are adjacent one another with the window therebetween, the second center plate being electrically connected to the second inner conductor and the second surrounding plate being electrically connected to the second shield conductor; and a first inductor that is electrically connected between the first center plate and the first surrounding plate and a second inductor that is electrically connected between the second center plate and the second surrounding plate;

wherein the first inner conductor is electrically connected to the first center plate at a first position thereon and wherein the first inductor is electrically connected to the first center plate at a second position that is remote from the first position; and wherein the second inner conductor is electrically connected to the second center plate at a first position thereon and wherein the second inductor is electrically connected to the second center plate at a second position that is remote from the first position.

29. A system according to claim 28 wherein the first and second center plates are first and second disks and wherein the first and second surrounding plates are first and second rings.

30. A system according to claim 29 wherein the first and second rings are first and second continuous rings.

31. A system according to claim 28 wherein the first position on the first center plate is adjacent the second position on the second center plate and wherein the second position on the first center plate is adjacent the first position on the second center plate.

32. A system according to claim 31 wherein the first shield conductor is electrically connected to the first surrounding plate at a first position thereon and wherein the second shield conductor is electrically connected to the second surrounding plate at a second position thereon that is remote from the first position on the first surrounding plate.

33. A system according to claim 32 wherein the first shield conductor is electrically connected to the first surrounding plate at a first position thereon and wherein the second shield conductor is electrically connected to the second surrounding plate at a second position thereon that is opposite the first position on the first surrounding plate.

34. A system according to claim 28 wherein the first shield conductor is electrically connected to the first surrounding plate at a first position thereon and wherein the second shield conductor is electrically connected to the second surrounding plate at a second position thereon that is opposite the first position on the first surrounding plate.

35. A system that couples an antenna to a radiotelephone through a window including an outside surface and an inside surface, the system comprising:

a first coaxial cable that includes a first inner conductor and a first shield conductor that are coupled to the antenna;

a second coaxial cable that includes a second inner conductor and a second shield conductor that are coupled to the radiotelephone;

a first center plate and a first surrounding plate that are attached to the outside surface such that the first surrounding plate surrounds the first center plate on the first surface, the first center plate being electrically connected to the first inner conductor and the first surrounding plate being electrically connected to the first shield conductor; and a second center plate and a second surrounding plate that are attached to the inside surface such that the second surrounding plate surrounds the second center plate on the inside surface, the first and second center plates are adjacent one another with the window therebetween and the first and second surrounding plates are adjacent one another with the window therebetween, the second center plate being electrically connected to the second inner conductor and the second surrounding plate being electrically connected to the second shield conductor;

wherein the first shield conductor is electrically connected to the first surrounding plate at a first position thereon and wherein the second shield conductor is electrically connected to the second surrounding plate at a second position thereon that is not adjacent the first position on the first surrounding plate.

36. A system according to claim 35 wherein the first and second center plates are first and second disks and first and second surrounding plates are first and second rings.

37. A system according to claim 36 wherein the first and second rings are first and second continuous rings.

38. A system according to claim 35 further comprising a first inductor that is electrically connected between the first center plate and the first surrounding plate and a second inductor that is electrically connected between the second center plate and the second surrounding plate.

39. A system according to claim 38:

wherein the first inner conductor is electrically connected to the first center plate at a first position thereon and wherein the first inductor is electrically connected to the first center plate at a second position that is remote from the first position; and wherein the second inner conductor is electrically connected to the second center plate at a first position thereon and wherein the second inductor is electrically connected to the second center plate at a second position that is remote from the first position.

40. A system that couples an antenna to a radiotelephone through a window including an outside surface and an inside surface the system comprising:

a first coaxial cable that includes a first inner conductor and a first shield conductor that are coupled to the antenna;

a second coaxial cable that includes a second inner conductor and a second shield conductor that are coupled to the radiotelephone;

a first center plate and a first surrounding plate that are attached to the outside surface such that the first surrounding plate surrounds the first center plate on the first surface, the first center plate being electrically connected to the first inner conductor and the first surrounding plate being electrically connected to the first shield conductor; and a second center plate and a second surrounding plate that are attached to the inside surface such that the second surrounding plate surrounds the second center plate on the inside surface, the first and second center plates are adjacent one another with the window therebetween and the first and second surrounding plates are adjacent one another with the window therebetween, the second center plate being electrically connected to the second inner conductor and the second surrounding plate being electrically connected to the second shield conductor;

wherein the first center plate and the first surrounding plate define a first gap therebetween, wherein the second center plate and the second surrounding plate define a second gap therebetween, wherein the first shield conductor extends into the first gap and wherein the second shield conductor extends into the second gap.

41. A system according to claim 40 wherein the first shield conductor extends midway into the first gap and wherein the second shield conductor extends midway into the second gap.

42. A system according to claim 40 wherein the first and second center plates are first and second disks and first and second surrounding plates are first and second rings.

43. A system according to claim 42 wherein the first and second rings are first and second continuous rings.

44. A system according to claim 40 further comprising a first inductor that is electrically connected between the first center plate and the first surrounding plate and a second inductor that is electrically connected between the second center plate and the second surrounding plate.

45. A system according to claim 44:

wherein the first inner conductor is electrically connected to the first center plate at a first position thereon and wherein the first inductor is electrically connected to the first center plate at a second position that is remote from the first position; and wherein the second inner conductor is electrically connected to the second center plate at a first position thereon and wherein the second inductor is electrically connected to the second center plate at a second position that is remote from the first position.

46. A system that couples an antenna to a radiotelephone through a window including an outside surface and an inside surface, the system comprising:

a first coaxial cable that includes a first inner conductor and a first shield conductor that are coupled to the antenna;

a second coaxial cable that includes a second inner conductor and a second shield conductor that are coupled to the radiotelephone;

a first center plate and a first surrounding plate that are attached to the outside surface such that the first surrounding plate surrounds the first center plate on the first surface, the first center plate being electrically connected to the first inner conductor and the first surrounding plate being electrically connected to the first shield conductor; and a second center plate and a second surrounding plate that are attached to the inside surface such that the second surrounding plate surrounds the second center plate on the inside surface, the first and second center plates are adjacent one another with the window therebetween and the first and second surrounding plates are adjacent one another with the window therebetween, the second center plate being electrically connected to the second inner conductor and the second surrounding plate being electrically connected to the second shield conductor;

a first inductor that is electrically connected between the first center plate and the first surrounding plate and a second inductor that is electrically connected between the second center plate and the second surrounding plate;

a pair of first pads, a respective one of which is on the first center plate and on the first surrounding plate, the first inductor being electrically connected between the pair of first pads; and a pair of second pads, a respective one of which is on the second center plate and on the second surrounding plate, the second inductor being electrically connected between the pair of second pads.

47. A system according to claim 46 wherein the first and second center plates are first and second disks and first and second surrounding plates are first and second rings.

48. A system according to claim 47 wherein the first and second rings are first and second continuous rings.

49. A system according to claim 46:

wherein the first inner conductor is electrically connected to the first center plate at a first position thereon and wherein the first inductor is electrically connected to the first center plate at a second position that is remote from the first position; and wherein the second inner conductor is electrically connected to the second center plate at a first position thereon and wherein the second inductor is electrically connected to the second center plate at a second position that is remote from the first position.

50. A system that couples an antenna to a radiotelephone through a window including an outside surface and an inside surface, the system comprising:

a first coaxial cable that includes a first inner conductor and a first shield conductor that are coupled to the antenna;

a second coaxial cable that includes a second inner conductor and a second shield conductor that are coupled to the radiotelephone;

a first center plate and a first surrounding plate that are attached to the outside surface such that the first surrounding plate surrounds the first center plate on the first surface, the first center plate being electrically connected to the first inner conductor and the first surrounding plate being electrically connected to the first shield conductor; and a second center plate and a second surrounding plate that are attached to the inside surface such that the second surrounding plate surrounds the second center plate on the inside surface, the first and second center plates are adjacent one another with the window therebetween and the first and second surrounding plates are adjacent one another with the window therebetween, the second center plate being electrically connected to the second inner conductor and the second surrounding plate being electrically connected to the second shield conductor;

a first housing that contains the first center plate and the first surrounding plate;

a second housing that contains the second center plate and the second surrounding plate; and an alignment key on at least one of the first and second housings that facilitates alignment of the first housing and the second housing relative to one another on the respective outer and inner surfaces of the window.

51. A system according to claim 50 wherein the first and second center plates are first and second disks and first and second surrounding plates are first and second rings.

52. A system according to claim 51 wherein the first and second rings are first and second continuous rings.

53. A system according to claim 50 further comprising a first inductor that is electrically connected between the first center plate and the first surrounding plate and a second inductor that is electrically connected between the second center plate and the second surrounding plate.

54. A system according to claim 53:

wherein the first inner conductor is electrically connected to the first center plate at a first position thereon and wherein the first inductor is electrically connected to the first center plate at a second position that is remote from the first position; and wherein the second inner conductor is electrically connected to the second center plate at a first position thereon and wherein the second inductor is electrically connected to the second center plate at a second position that is remote from the first position.

55. A system that couples a first coaxial cable that includes a first inner conductor and a first shield conductor to a second coaxial cable that includes a second inner conductor and a second shield conductor, through an insulator that includes first and second insulator surfaces, the system comprising:

a first center plate and a first surrounding plate;

means for attaching the first center plate and the first surrounding plate to the first insulator surface such that the first surrounding plate surrounds the first center plate on the first insulator surface;

means for electrically connecting the first center plate to the first inner conductor and the first surrounding plate to the first shield conductor;

a second center plate and a second surrounding plate;

means for attaching the second center plate and the second surrounding plate to the second insulator surface such that the second surrounding plate surrounds the second center plate on the second insulator surface, the first and second center plates are adjacent one another with the insulator therebetween and the first and second surrounding plates are adjacent one another with the insulator therebetween; and means for electrically connecting the second center plate to the second inner conductor and the second surrounding plate to the second shield conductor; and first means for inductively coupling the first center plate and the first surrounding plate and second means for inductively coupling the second center plate and the second surrounding plate;

wherein the first means for inductively coupling comprises a first inductor that is electrically connected between the first center plate and the first surrounding plate, wherein the first inner conductor is electrically connected to the first center plate at a first position thereon and wherein the first inductor is electrically connected to the first center plate at a second position that is remote from the first position; and wherein the second means for inductively coupling comprises a second inductor that is electrically connected between the second center plate and the second surrounding plate, wherein the second inner conductor is electrically connected to the second center plate at a first position thereon and wherein the second inductor is electrically connected to the second center plate at a second position that is remote from the first position.

56. A system according to claim 55 wherein the first position on the first center plate is adjacent the second position on the second center plate and wherein the second position on the first center plate is adjacent the first position on the second center plate.

57. A system according to claim 55 wherein the first shield conductor is electrically connected to the first surrounding plate at a first position thereon and wherein the second shield conductor is electrically connected to the second surrounding plate at a second position thereon that is opposite the first position on the first surrounding plate.

58. A system according to claim 55 further comprising:

first means for containing the first center plate and the first surrounding plate;

second means for containing the second center plate and the second surrounding plate; and means for facilitating alignment of the first means for containing and the second means for containing relative to one another on the respective first and second surfaces of the insulator.

59. A system according to claim 55 further comprising means for coupling at least two ports to at least one of the first and second coaxial cables.

60. A system that couples a first coaxial cable that includes a first inner conductor and a first shield conductor to a second coaxial cable that includes a second inner conductor and a second shield conductor, through an insulator that includes first and second insulator surfaces, the system comprising:

a first center plate and a first surrounding plate;

means for attaching the first center plate and the first surrounding plate to the first insulator surface such that the first surrounding plate surrounds the first center plate on the first insulator surface;

means for electrically connecting the first center plate to the first inner conductor and the first surrounding plate to the first shield conductor;

a second center plate and a second surrounding plate;

means for attaching the second center plate and the second surrounding plate to the second insulator surface such that the second surrounding plate surrounds the second center plate on the second insulator surface, the first and second center plates are adjacent one another with the insulator therebetween and the first and second surrounding plates are adjacent one another with the insulator therebetween; and means for electrically connecting the second center plate to the second inner conductor and the second surrounding plate to the second shield conductor;

wherein the first shield conductor is electrically connected to the first surrounding plate at a first position thereon and wherein the second shield conductor is electrically connected to the second surrounding plate at a second position thereon that is not adjacent the first position on the first surrounding plate.

61. A system according to claim 60 further comprising first means for inductively coupling the first center plate and the first surrounding plate and second means for inductively coupling the second center plate and the second surrounding plate.

62. A system according to claim 61:

wherein the first means for inductively coupling comprises a first inductor that is electrically connected between the first center plate and the first surrounding plate, wherein the first inner conductor is electrically connected to the first center plate at a first position thereon and wherein the first inductor is electrically connected to the first center plate at a second position that is remote from the first position; and wherein the second means for inductively coupling comprises a second inductor that is electrically connected between the second center plate and the second surrounding plate, wherein the second inner conductor is electrically connected to the second center plate at a first position thereon and wherein the second inductor is electrically connected to the second center plate at a second position that is remote from the first position.

63. A system according to claim 60 further comprising:

first means for containing the first center plate and the first surrounding plate;

second means for containing the second center plate and the second surrounding plate; and means for facilitating alignment of the first means for containing and the second means for containing relative to one another on the respective first and second surfaces of the insulator.

64. A system according to claim 60 further comprising means for coupling at least two ports to at least one of the first and second coaxial cables.

65. A system that couples a first coaxial cable that includes a first inner conductor and a first shield conductor to a second coaxial cable that includes a second inner conductor and a second shield conductor through an insulator that includes first and second insulator surfaces the system comprising:

a first center plate and a first surrounding plate;

means for attaching the first center plate and the first surrounding plate to the first insulator surface such that the first surrounding plate surrounds the first center plate on the first insulator surface;

means for electrically connecting the first center plate to the first inner conductor and the first surrounding plate to the first shield conductor;

a second center plate and a second surrounding plate;

means for attaching the second center plate and the second surrounding plate to the second insulator surface such that the second surrounding plate surrounds the second center plate on the second insulator surface, the first and second center plates are adjacent one another with the insulator therebetween and the first and second surrounding plates are adjacent one another with the insulator therebetween; and means for electrically connecting the second center plate to the second inner conductor and the second surrounding plate to the second shield conductor;

wherein the first center plate and the first surrounding plate define a first gap therebetween, wherein the second center plate and the second surrounding plate define a second gap therebetween, wherein the first shield conductor extends into the first gap and wherein the second shield conductor extends into the second gap.

66. A system according to claim 65 further comprising first means for inductively coupling the first center plate and the first surrounding plate and second means for inductively coupling the second center plate and the second surrounding plate.

67. A system according to claim 66:

wherein the first means for inductively coupling comprises a first inductor that is electrically connected between the first center plate and the first surrounding plate, wherein the first inner conductor is electrically connected to the first center plate at a first position thereon and wherein the first inductor is electrically connected to the first center plate at a second position that is remote from the first position; and wherein the second means for inductively coupling comprises a second inductor that is electrically connected between the second center plate and the second surrounding plate, wherein the second inner conductor is electrically connected to the second center plate at a first position thereon and wherein the second inductor is electrically connected to the second center plate at a second position that is remote from the first position.

68. A system according to claim 65 further comprising:

first means for containing the first center plate and the first surrounding plate;

second means for containing the second center plate and the second surrounding plate; and means for facilitating alignment of the first means for containing and the second means for containing relative to one another on the respective first and second surfaces of the insulator.

69. A system according to claim 65 further comprising means for coupling at least two ports to at least one of the first and second coaxial cables.

70. A method for coupling a first coaxial cable that includes a first inner conductor and a first shield conductor to a second coaxial cable that includes a second inner conductor and a second shield conductor, through an insulator that includes first and second insulator surfaces, the method comprising the steps of:

attaching a first center plate and a first surrounding plate to the first insulator surface such that the first surrounding plate surrounds the first center plate on the first insulator surface;

electrically connecting the first center plate to the first inner conductor and the first surrounding plate to the first shield conductor;

attaching a second center plate and a second surrounding plate to the second insulator surface such that the second surrounding plate surrounds the second center plate on the second insulator surface, the first and second center plates are adjacent one another with the insulator therebetween and the first and second surrounding plates are adjacent one another with the insulator therebetween; and electrically connecting the second center plate to the second inner conductor and the second surrounding plate to the second shield conductor;

wherein the first shield conductor is electrically connected to the first surrounding plate at a first position thereon and wherein the second shield conductor is electrically connected to the second surrounding plate at a second position thereon, and wherein the step of attaching a second center plate and a second surrounding plate to the second insulator surface comprises the step of attaching the second center plate and the second surrounding plate to the second insulator surface such that the second position is not adjacent the first position on the first surrounding plate.

71. A method according to claim 70 further comprising the steps of:

inductively coupling the first center plate to the first surrounding plate; and inductively coupling the second center plate to the second surrounding plate.

72. A method according to claim 70 further comprising the step of coupling at least two ports to at least one of the first and second coaxial cables.

73. A method for coupling a first coaxial cable that includes a first inner conductor and a first shield conductor to a second coaxial cable that includes a second inner conductor and a second shield conductor, through an insulator that includes first and second insulator surfaces, the method comprising the steps of:

attaching a first center plate and a first surrounding plate to the first insulator surface such that the first surrounding plate surrounds the first center plate on the first insulator surface;

electrically connecting the first center plate to the first inner conductor and the first surrounding plate to the first shield conductor;

attaching a second center plate and a second surrounding plate to the second insulator surface such that the second surrounding plate surrounds the second center plate on the second insulator surface, the first and second center plates are adjacent one another with the insulator therebetween and the first and second surrounding plates are adjacent one another with the insulator therebetween;

electrically connecting the second center plate to the second inner conductor and the second surrounding plate to the second shield conductor; and wherein the step of attaching a first center plate and a first surrounding plate to the first insulator surface comprises the step of attaching a first housing that contains the first center plate and the first surrounding plate to the first surface such that the first surrounding plate surrounds the first center plate on the first insulator surface;

wherein the step of attaching a second center plate and a second surrounding plate to the second insulator surface comprises the step of attaching a second housing that contains the second center plate and the second surrounding plate to the second insulator surface such that the second surrounding plate surrounds the second center plate on the second insulator surface; and wherein at least one of the steps of attaching is preceded by the step of aligning the first housing and the second housing relative to one another on the respective first and second surfaces of the insulator.

74. A method according to claim 73 further comprising the steps of:

inductively coupling the first center plate to the first surrounding plate; and inductively coupling the second center plate to the second surrounding plate.

75. A method according to claim 73 wherein the first shield conductor is electrically connected to the first surrounding plate at a first position thereon and wherein the second shield conductor is electrically connected to the second surrounding plate at a second position thereon, and wherein the step of attaching a second center plate and a second surrounding plate to the second insulator surface comprises the step of attaching the second center plate and the second surrounding plate to the second insulator surface such that the second position is opposite the first position on the first surrounding plate.

76. A method according to claim 73 further comprising the step of coupling at least two ports to at least one of the first and second coaxial cables.

* * * * *